US006360522B1

(12) United States Patent
Walton

(10) Patent No.: US 6,360,522 B1
(45) Date of Patent: Mar. 26, 2002

(54) ROPE FOR CONVEYING SYSTEMS

(75) Inventor: John Mawson Walton, Doncaster (GB)

(73) Assignee: Bridon PLC (GB)

( * ) Notice: Subject to any disclaimer, the term of this patent is extended or adjusted under 35 U.S.C. 154(b) by 0 days.

(21) Appl. No.: 09/555,283

(22) PCT Filed: Dec. 9, 1998

(86) PCT No.: PCT/GB98/03666

§ 371 Date: Aug. 16, 2000

§ 102(e) Date: Aug. 16, 2000

(87) PCT Pub. No.: WO99/32709

PCT Pub. Date: Jul. 1, 1999

(30) Foreign Application Priority Data

Dec. 19, 1997 (GB) ..... 9726927

(51) Int. Cl.[7] ..... D02G 3/36

(52) U.S. Cl. ..... 57/212; 57/200; 57/211; 57/212; 57/213; 57/214; 57/215; 57/216; 57/217; 57/218; 57/219; 57/220; 57/221; 57/222; 57/223; 57/225

(58) Field of Search ..... 57/200, 211, 212, 57/213, 214, 215, 216, 217, 218, 219, 220, 221, 222, 223, 225

(56) References Cited

U.S. PATENT DOCUMENTS 5,669,214 A * 9/1997 Kopanakis ..... 57/218

FOREIGN PATENT DOCUMENTS

| | | | |
|---|---|---|---|
| EP | 0117122 | 8/1984 | ..... 1/6 |
| GB | 1182593 | 2/1970 | ..... 1/16 |
| GB | 2090305 | 7/1982 | ..... 1/16 |
| GB | 2144457 A | 3/1985 | ..... 1/16 |
| GB | 2280686 A | 2/1995 | ..... 1/6 |

* cited by examiner

*Primary Examiner*—John J. Calvert
*Assistant Examiner*—Shaun R Hurley
(74) *Attorney, Agent, or Firm*—Cesari and McKenna, LLP

(57) ABSTRACT

A filler element is located between each adjacent pair of outer strands of a wire rope and interlocks with the adjacent strands. The filler elements provide the rope with substantially smooth outer surface reducing vibration of the rope passing over a pulley. Filler elements are disclosed consisting of an elastometic or polymeric material having an oriented molecular structure aligned along the filler element and also aligned in a generally radial direction with respect to the rope.

18 Claims, 6 Drawing Sheets

ROPE FOR CONVEYING SYSTEMS

In an overland conveying system a wire rope is supported and guided by a series of pulleys over which it is dragged at high speed, the rope having only glancing or tangential contact with the pulleys. Examples of such systems are aerial haulage installations and cable belt installations.

One problem with such systems is premature failure of the rope. Another problem is strumming or vibration of the rope (and of the adjacent supporting structures), which may generate an unacceptable level of noise and vibration, which may be troublesome for the local community.

It would be desirable to be able to overcome or mitigate these problems.

We have found that a conventional wire rope 1, as shown in FIGS. 1 and 2, comprising six wire strands 2 (each consisting of wires extending helical around a central wire) extending helically around a core, tends to suffer small lateral displacements as it passes a pulley 3, owing to the undulating surface topography of the rope in the longitudinal direction. The magnitude, d, of the deflection can approach 1% of the rope diameter, depending on the respective profiles of the rope 1 and the pulley 3. We have found that these small rope perturbations can set up vibrations in the rope. These vibrations may represent a source of premature failure due to fatigue. Furthermore, the rope surface may suffer owing to repeated hammering of the pulley on the crowns of the outer wires of the rope.

For the purpose of preventing ingress of abrasives and retaining lubricant, in the field of haulage ropes, it is already known to fill a rope with plastics material. However, if plastics filler elements are introduced into the rope construction, this can cause problems in the manufacture of the rope, because of the difference in physical properties between the (steel) wires and the plastics elements.

It would therefore be desirable to be able to provide a rope which is more easy to manufacture than a conventional plastics filled rope.

The present invention provides a wire rope comprising a central core, a plurality of helical outer strands over the central core, and a plurality of separate pre-formed filler elements, in which one filler element is located between each adjacent pair of outer strands and interlocks with the adjacent strands, the filler elements extending to the imaginary cylindrical envelope of the rope, each filler element consisting of an elastomeric or polymeric material having an oriented molecular structure due to solid-state deformation, the oriented molecular structure being aligned along the filler element.

An oriented molecular structure can be produced by solid state elongation under tension. The oriented structure may be a crystalline or quasi-crystalline structure and may contain whisker-like crystals, whose length will depend on the degree of polymerisation and on the draft (ratio of initial cross-section to final cross-section). If a change in cross-sectional shape takes place at the same time, the oriented structure may have an additional alignment transverse to the longitudinal direction, i.e. there may be biaxial orientation as the material flows in a transverse direction. This is particularly the case if a filler element is formed by solid state drawing of an initially round rod to form a waisted element.

The oriented structure provides the filler element with a high tensile strength and high modulus of elasticity, so that it may be handled in much the same way as a steel element, thereby facilitating manufacture of the rope.

The invention will be described further, by way of example, with reference to the accompanying drawings, in which.

Figure 1:
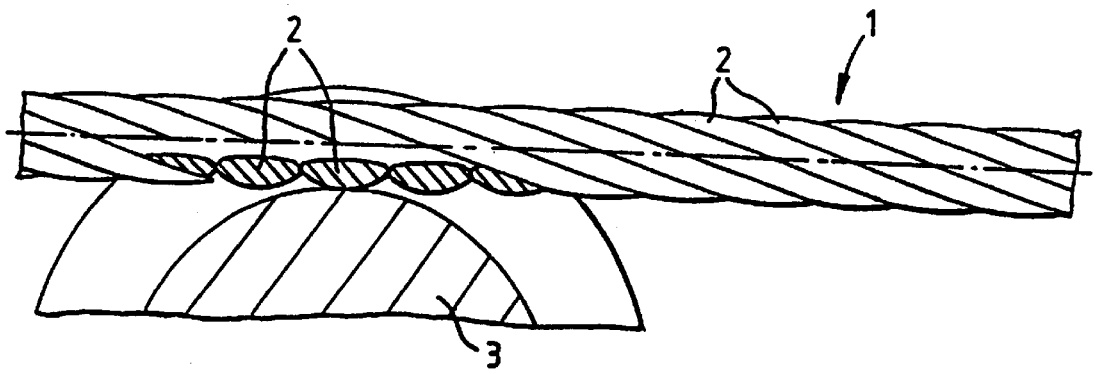
Fig. 1 PRIOR ART
FIG. 1 is a part-sectioned side elevation of a conventional rope running over a pulley in a conveying system, one strand of the rope being in contact with the pulley.
Figure 2:
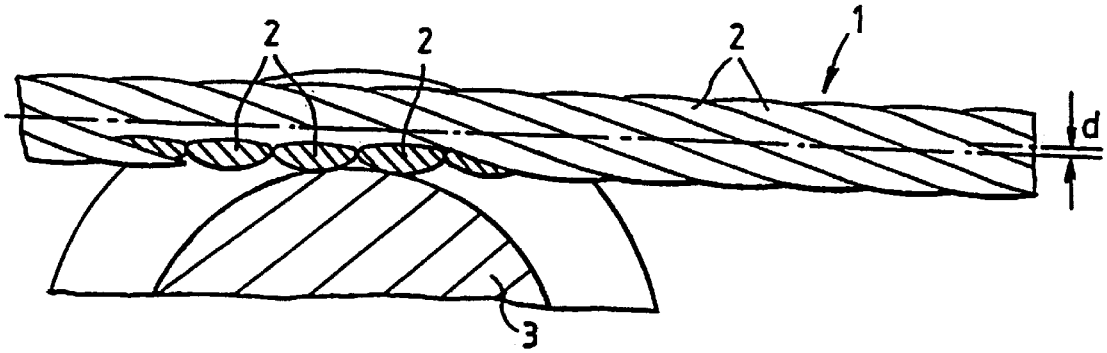
Fig. 2 PRIOR ART
FIG. 2 is a view similar to FIG. 1, but with two strands in contact with the pulley.
Figure 3:
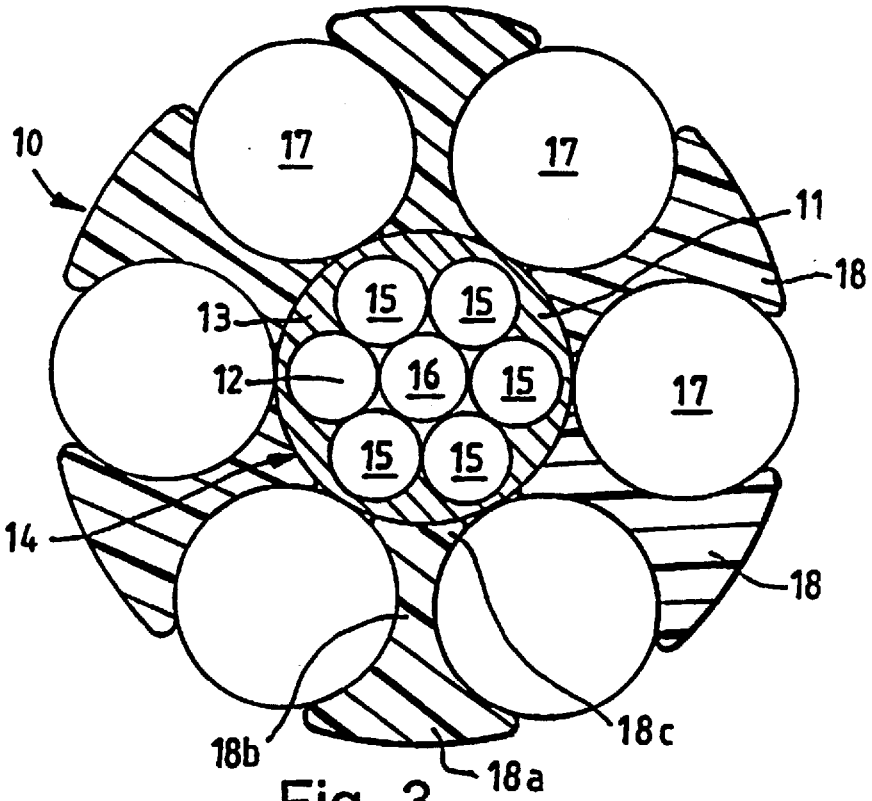
FIG. 3 is a diagrammatic cross-section of a rope in a first embodiment.

Referring to FIG. 3, a rope 10 is shown having a central core 11 comprising an independent wire rope core (IWRC) 12 which has been pressure extruded with an elastomeric or polymeric material 13 so as to present a substantially smooth cylindrical outer surface 14. The IWRC 12 comprises six helical strands 15 wound on a core strand 16, each strand consisting of helical wires wound on a central core. The IWRC 12 may be replaced by a strand or by a fibre core.

Six helical outer strands 17 are wound on the central core 11, which is of larger diameter, and are spaced apart by filler elements 18 which also extend helically. The illustration is diagrammatic in that the envelope of each strand 17 is shown as a circle, although the strand is of course made up of helical wires wound on a central wire. Each filler element 18 has an enlarged head portion 18*a* which occupies the outer valley between adjacent strands and whose outer surface approximates to the imaginary circumscribing cylindrical envelope of the rope 10, an enlarged foot portion 18*c* which rests on the central core 11 and occupies the inner valley between adjacent strands, thereby interlocking with them, and a waisted intermediate web portion 18*b*. The filler element 18 is made of elastomeric or polymeric material which has been uniaxially or biaxially oriented.

Figure 4:
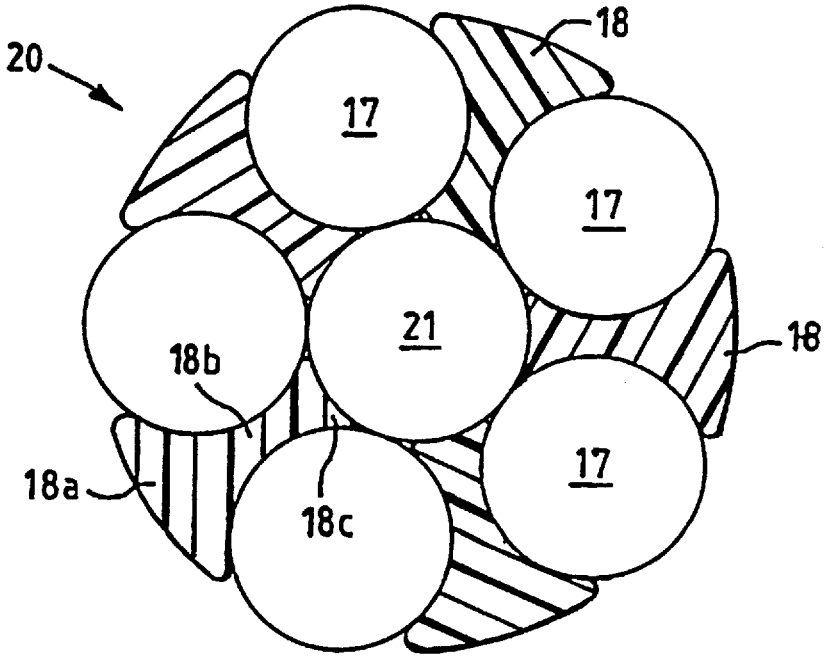
FIG. 4 is a diagrammatic cross-section of a rope in a second embodiment.

The rope 20 shown in FIG. 4 differs from the rope 10 of FIG. 3 in that there are five outer strands 17, and the central core 21 is a strand of substantially the same diameter.

Figure 5:
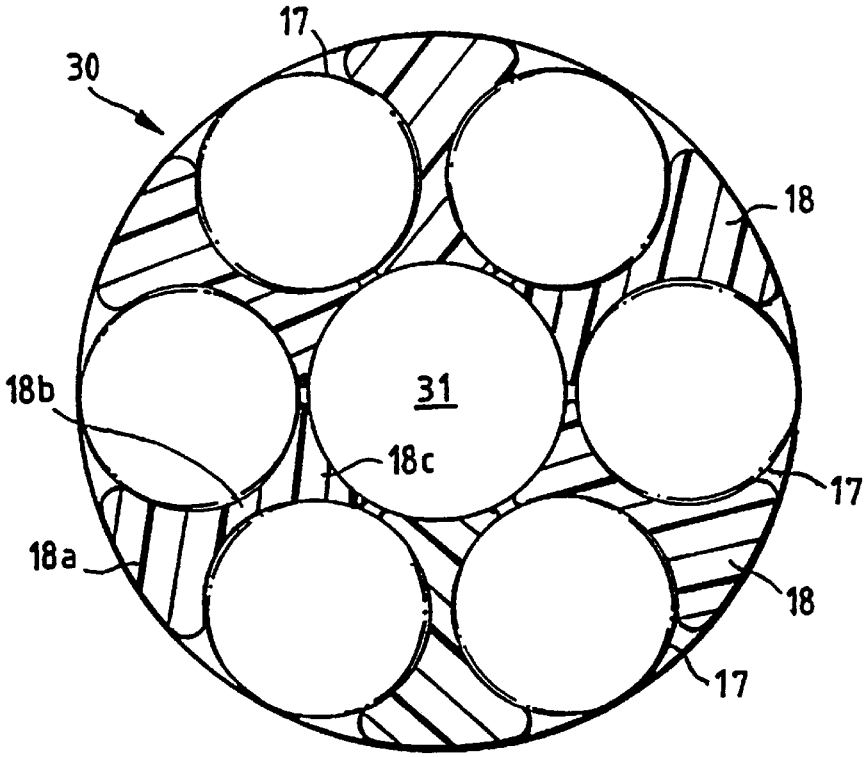
FIG. 5 is a diagrammatic cross-section of a rope in a third embodiment.

FIG. 5 shows a diagrammatic cross-section of a rope 30, similar to the rope 10 of FIG. 3, which is more accurate in that the cross-section of the envelope of each outer strand 17 is correctly shown as an ellipse whose minor axis extends radially. The central core 31 is an IWRC (or a strand). The foot portions 18*c* of the filler elements 18 are shown as spacing the strands 17 from the core 31. However, when the rope 30 is under tension, the wires of the strands 17 and of the core 31 will bite into the relatively soft material of the foot portions 18*c*, so that the strands will come into contact with the core.

Figure 6:
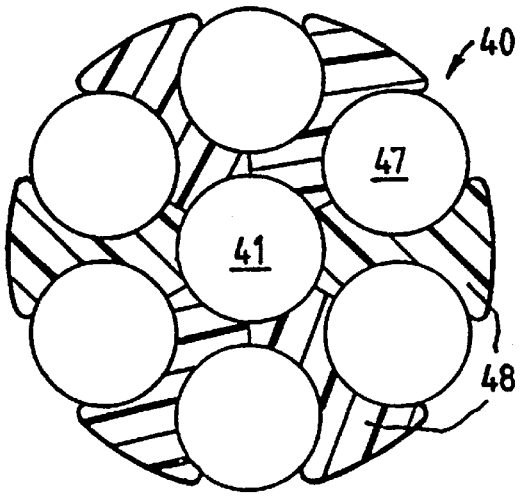
FIG. 6 is a diagrammatic cross-section of a rope in a fourth embodiment.
Figure 7:
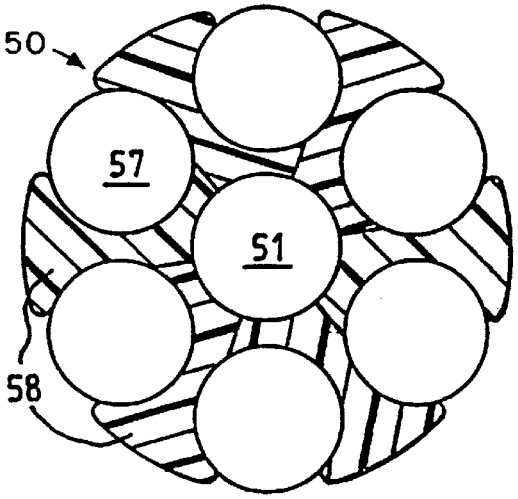
FIG. 7 is a diagrammatic cross-section of a rope in a fifth embodiment.
Figure 8:
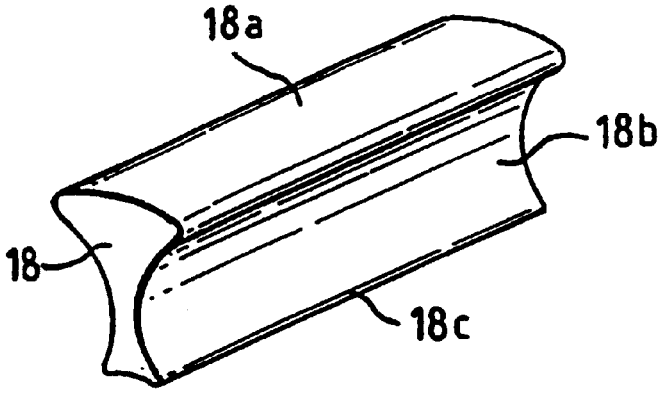
FIG. 8 is a perspective view of a section of the length of a filler element of the rope shown in FIG. 5.

FIGS. 6 and 7 show ropes 40 and 50 with six outer strands 47 and 57, a central core strand 41 and 51, and filler elements 48 and 58 which positively space the strands 47 and 57 from the core strand 41 and 51.

In each of the above-described embodiments the filler element 18 (48,58) is produced by solid state deformation of an elongate body of an elastomeric or polymeric material which is capable of molecular orientation. Such a material may be a polypropylene, a polyamide, or a thermoplastic elastomer, in particular a polyester elastomer. Solid state drawing results in the material having an oriented molecular structure aligned along the filler element. This imparts tensile strength and resilience without impairing rope flexibility. If the solid state deformation involves a change in cross-section such that the material flows transversely to the longitudinal direction then the oriented molecular structure will also be aligned in the transverse direction as well as the longitudinal direction.

Figure 9:
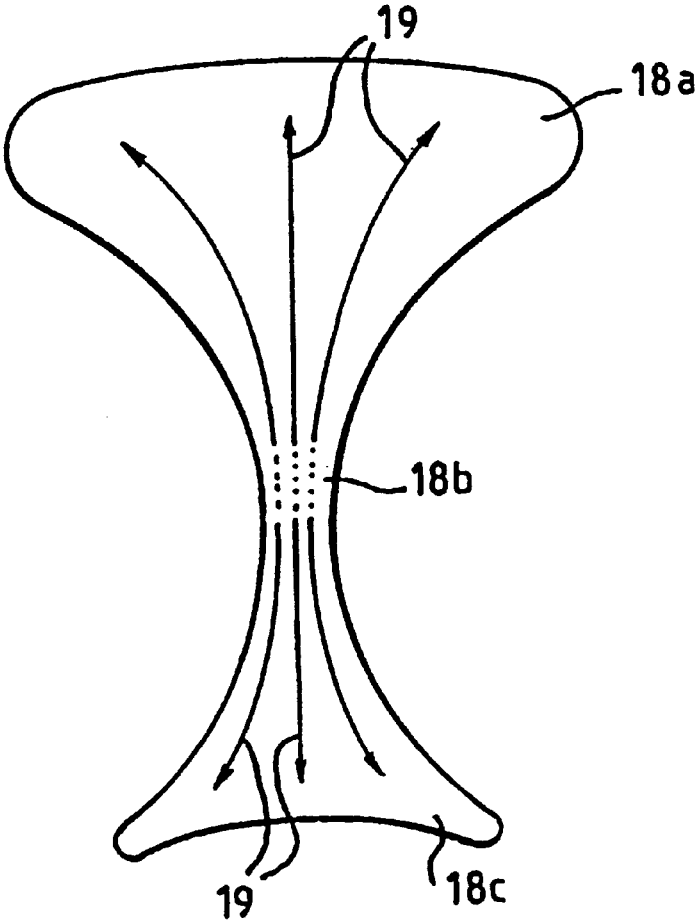
FIG. 9 is a diagrammatic cross-section of the filler element of FIG. 8, showing the direction in which the material has flowed during solid state drawing.

FIG. 9 shows the way in which the material flows when a filler element 18 is drawn down from a cylindrical rod. The molecular structure will be aligned in the direction of the arrows 19, i.e. generally radially, as well as the longitudinal direction, with additional strengthening of the web portion 18*b*.

Figure 10:
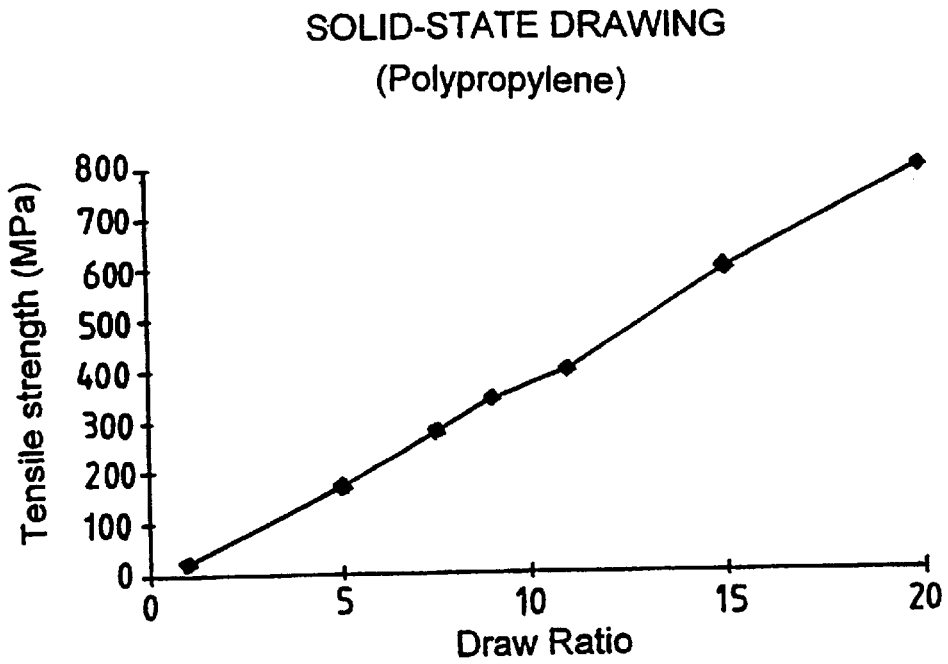
FIG. 10 is a graph of tensile strength (MPa) versus draw ratio in respect of the solid state drawing of polypropylene rod to form a fluted rod of smaller diameter.
Figure 11:
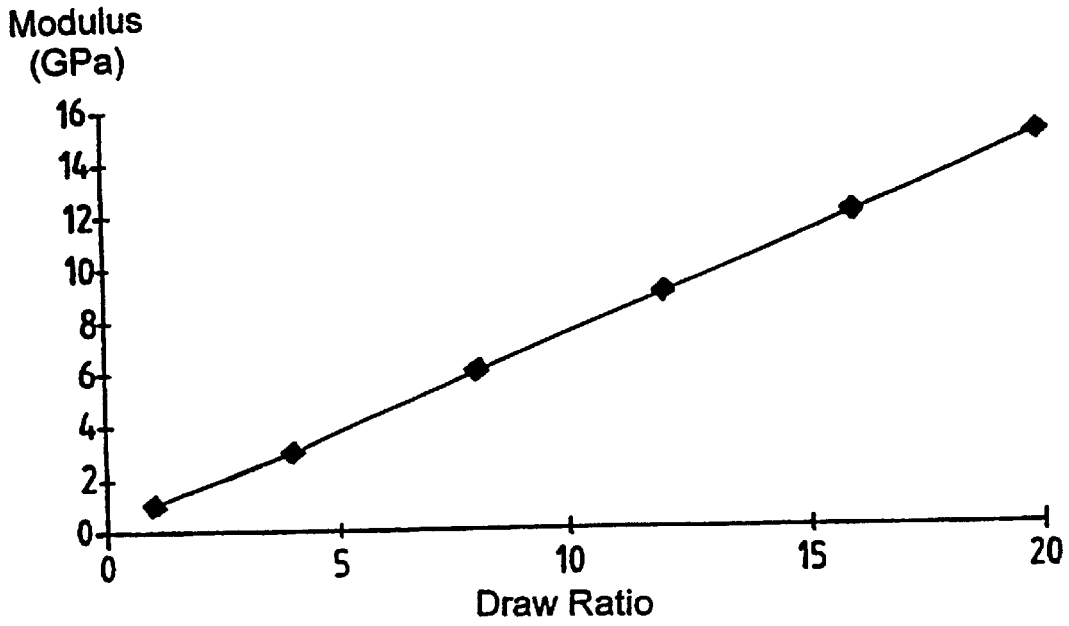
FIG. 11 is a corresponding graph of the modulus of elasticity of the drawn fluted rod (GPa) in the axial direction.

FIGS. 10 and 11 illustrate the effect of various draw ratios on the tensile strength and longitudinal elastic modulus of polypropylene rod when drawn to produce a fluted shape.

Figure 12:
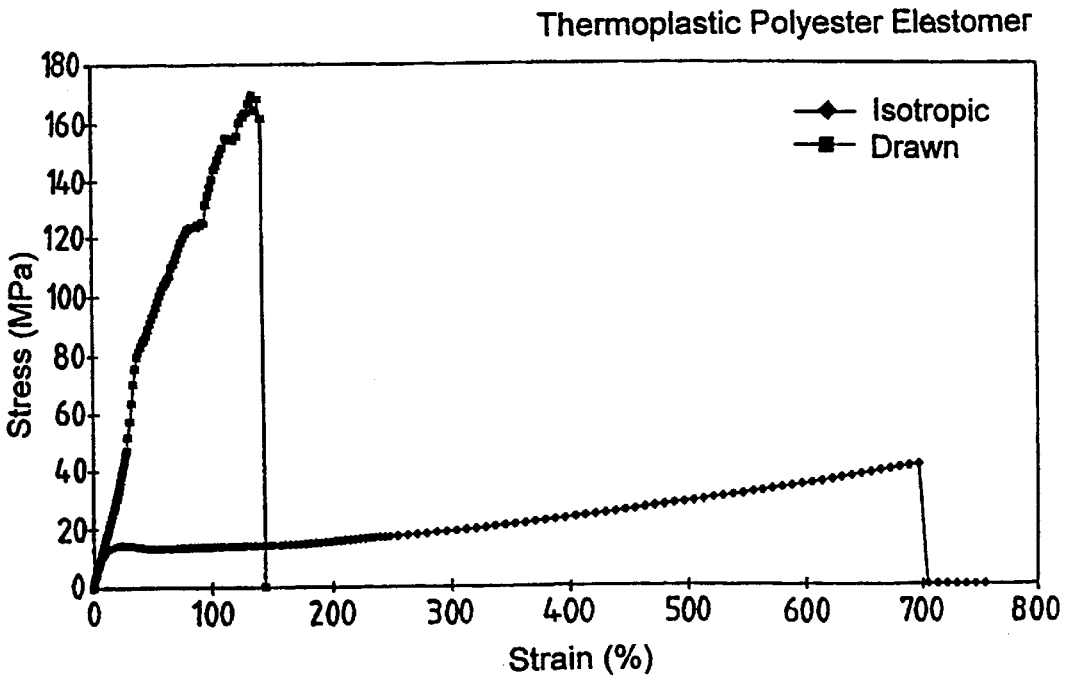
FIG. 12 is a graph of stress (MPa) versus strain (%) for an engineering thermoplastic elastomer, before and after solid state drawing with a draw ratio of 5:1.

FIG. 12 illustrates the effect of drawing a rod of an engineering thermoplastic elastomer (a polyester elastomer available under the registered trade mark HYTREL).

By selecting suitable materials and suitable draw ratios it is possible to achieve filler elements with tensile strengths exceeding 100 MPa, preferably exceeding 200 MPa, and more preferably exceeding 400 MPa, and with longitudinal elastic moduli exceeding 2 GPa, preferably exceeding 4 GPa, and more preferably exceeding 8 GPa.

Various modifications may be made within the scope of the invention. In particular, the filler elements (18, 48, 58) may consist of an elastomeric or polymeric material containing a dispersion of reinforcing fibres which have been preferentially oriented in the longitudinal direction. The central core (11, 21, 31, 41, 51) may comprise a cylindrical rod of elastomeric or polymeric material having an oriented molecular structure aligned along the core. The filler elements (18, 48, 58) may be designed to extend just beyond the cylindrical envelope of the outer stands (17, 47, 57), e.g. by up to 5% of the rope diameter, to allow for their elasticity relative to steel and to allow for wear.

What is claimed is:

1. A wire rope comprising a central core, a plurality of helical outer strands over the central core, and a plurality of separate pre-formed filler elements, in which one filler element is located between each adjacent pair of outer strands and interlocks with the adjacent strands, the filler elements extending to the imaginary cylindrical envelope of the rope, each filler element consisting of an elastomeric or polymeric material having an oriented molecular structure due to solid-state deformation, the oriented molecular structure having an orientation axis extending longitudinally of the filler element.

2. A wire rope comprising a central core, a plurality of helical outer strands over the central core, and a plurality of separate pre-formed filler elements, in which one filler element is located between each adjacent pair of outer strands and interlocks with the adjacent strands, the filler elements extending to the imaginary cylindrical envelope of the rope, each filler element consisting of an elastomeric or polymeric material having a biaxially oriented molecular structure due to solid-state deformation, the biaxially oriented molecular structure having a first orientation axis extending longitudinally of the filler element and a second orientation axis extending transversely to the first orientation axis.

3. A wire rope comprising a central core, a plurality of helical outer strands over the central core, and a plurality of separate pre-formed filler elements, in which one filler element is located between each adjacent pair of outer strands and interlocks with the adjacent strands, the filler elements extending to the imaginary cylindrical envelope of the rope, each filler element consisting of an elastomeric or polymeric material having an oriented molecular structure due to solid-state drawing of an initially round rod.

4. A wire rope as claimed in any of claims 1 to 3, in which the tensile strength of each filler element exceeds 100 MPa.

5. A wire rope as claimed in any of claims 1 to 3, in which the modulus of elasticity of each filler element in the longitudinal direction exceeds 2 GPa.

6. A wire rope as claimed in any of claims 1 to 3, in which the filler elements are of a material selected from the group consisting of polypropylene, polyamide, or polyester.

7. A wire rope as claimed in any of claims 1 to 3, in which the filler elements consist of a thermoplastic elastomer.

8. A wire rope as claimed in any of claims 1 to 3, in which each filler element has an enlarged head portion occupying an outer valley between a pair of adjacent strands, an enlarged foot portion occupying an inner valley between the adjacent strands, and a waisted intermediate portion.

9. A wire rope as claimed in claim 8, in which the foot portion rests on the central core.

10. A wire rope as claimed in any of claims 1 to 3, in which the filler elements extend beyond the imaginary cylindrical envelope of the outer strands.

11. A wire rope as claimed in any of claims 1 to 3, in which each filler element consists of an elastomeric or polymeric material containing a dispersion of reinforcing fibres preferentially oriented along the filler element.

12. A wire rope as claimed in any of claims 1 to 3, having five or six outer strands.

13. A wire rope as claimed in any of claims 1 to 3, in which the central core comprises a cylindrical rod of elastomeric or polymeric material having an oriented molecular structure aligned along the core.

14. A wire rope as claimed in any of claims 1 to 3, in which the central core comprises a strand or independent wire rope core which has been pressure extruded with an elastomeric or polymeric material.

15. A wire rope as claimed in any of claims 1 to 3 in which the tensile strength of each filler element exceeds 200 MPa.

16. A wire rope as claimed in any of claims 1 to 3 in which the tensile strength of each filler element exceeds 400 MPa.

17. A wire rope as claimed in any of claims 1 to 3, in which the modulus of elasticity of each filler element in the longitudinal direction exceeds 4 GPa.

18. A wire rope as claimed in any of claims 1 to 3, in which the modulus of elasticity of each filler element in the longitudinal direction exceeds 8 GPa.

* * * * *